United States Patent [19]

Hollweck

[11] Patent Number: 4,899,124

[45] Date of Patent: Feb. 6, 1990

[54] THERMALLY CONTROLLED ELECTRIC SWITCH

[75] Inventor: Walter Hollweck, Heroldsberg, Fed. Rep. of Germany

[73] Assignee: Thermostat-und Schaltgeraetebau GmbH & Co. KG, Bad Kissingen, Fed. Rep. of Germany

[21] Appl. No.: 259,275

[22] Filed: Oct. 18, 1988

[30] Foreign Application Priority Data

Oct. 19, 1987 [DE] Fed. Rep. of Germany ..... 3735334

[51] Int. Cl.[4] ..... H01H 37/02

[52] U.S. Cl. ..... 337/299; 337/3; 337/67

[58] Field of Search ..... 337/4, 5, 97, 98, 363, 337/364, 365, 366, 367, 368, 369, 377, 372, 375, 67, 3, 12, 13

[56] References Cited

U.S. PATENT DOCUMENTS 3,964,004 6/1976 Mertler ..... 337/67

4,295,114 10/1981 Pohl ..... 337/3

*Primary Examiner*—H. Broome

*Attorney, Agent, or Firm*—Robin, Blecker, Daley & Driscoll

[57] ABSTRACT

A thermally controlled electric switching arrangement with a temperature controller, having a snap-action switch actuated by a bimetallic strip and of which the dead center position is displaceable by a manually operable setting device in order to influence the control point, and with a temperature limiter which is constructed as a melting metal fuse which comprises a fusible element, pressure elements engaging therein and at least one switching contact held in the closed position by the pressure element, so long as the limiter has not responded, is structurally simplified, the simplification also being intended to improve the variability of installation of the switching arrangement. This is achieved in that the movable contact of the temperature limiter which is actuated by a thrust pin biases a first contact face of the fixed contact of the temperature limiter, which is opposite a second contact face of the fixed contact which is biased by the movable contact of the temperature controller.

25 Claims, 4 Drawing Sheets

THERMALLY CONTROLLED ELECTRIC SWITCH

FIELD OF THE INVENTION

The invention relates to a thermally controlled electric switching arrangement.

BACKGROUND OF THE INVENTION

German Patent Specification No. 23 39 674 discloses a temperature controller having a snap-action switch actuated by a bimetallic strip wherein the dead center position can be displaced by a manually operable setting device in order to influence the control point. Associated with this temperature controller is a temperature limiter which is constructed as a melting metal fuse comprising substantially a fusible part (fuse plug) and a pressure element which engages therein, and at least one switching contact held in the closed position by a pressure element so long as the temperature limiter has not responded. The setting device, the contact springs and fixed contacts, the bimetallic strip and a supporting element for the melting metal fuse are disposed on an elongate supporting member through interposed spacers.

Such prior art temperature controller with melting metal fuse is disadvantageous in so far as both the controller and also the limiter comprise separate fixed contact elements and when this combination is installed, for example, in domestic appliances such as an iron or the like, the user is rigidly tied to the structural circumstances afforded by the appliance.

SUMMARY OF THE INVENTION

The present invention addressed the problem of structurally simplifying such known prior art device, the simplification also being intended to improve the versatility of the switching arrangement.

By reason of the simplification of the known prior art device in the fixed contact area, namely, the combinatio of the fixed contact of the controller with the fixed contact of the limiter, it is possible to simplify the circuitry within the device, to simplify the mechanical construction and achieve improved response of the over-temperature safety device and make the switch less expensive. Furthermore, simplification of the fixed contact makes it possible, in a space-saving and compact manner, to integrate the limiter between the components parts of the controller.

It is expedient in the spirit of the present invention for the fixed contact to be constructed as a plate traversed by the supporting member, the plate being biased on its upper face by the moving contact of the snap-action switch and on the underside by the moving contact of the temperature limiter. Reference in this case to the upper and undersides of the plate also embraces the fact that the controller, in relation to the limiter, is disposed in a raidially offset arrangement around the supporting member. In order to improve the making of a contact, it may be expedient to provide the fixed contact withat least one contact nipple biased on both sides by the two moving contacts.

The fixed contact and moving contact of the temperature limiter of the invention are disposed spatially between the snap-action switch and the bimetallic strip to provide a particularly compact construction and both temperature-sensitive elements, namely controller and limiter, respond to substantially identical temperature sources and influences.

There are several possible ways of disposing the fusible element in the switch according to the invention. In conventional manner, the fusible element may for example be supported on a heat transfer element, such support being provided by or at least with the aid of the pressure exerted on it (contact closure pressure) by the moving contact of the temperature limiter on the one hand and the first contact face on the other. If the heat transfer element extends parallel with the bimetallic strip, then this can provide a further advantageous effect, namely a transfer of radiated heat to the side of the bimetallic strip which is remote from the heated element, so that the bimetallic strip is thermally influenced from two sides equally, so that its response behavior is further improved. The moving contact of the temperature limiter is supported on the first contact face of the fixed contact so that within the elastic limits of the moving contact, retaining forces arise which press the fusible element against the mounting of the heat transfer element. Similarly, the fusible element can also be supported at the root of the bimetallic strip, the premise here being that during the control process, the root of the bimetallic strip performs only very negligible movements which cannot have a negative effect on the way the limiter makes contact. Advantageous in this solution is that the fusible element of the limiter and the bimetallic element of the controller, i.e., the two temperature-sensitive elements, are at the same temperature so that the device as a whole achieves a very accurate and reproducible response behavior pattern.

A particularly improved response of the limiter device is possible if the fusible element is mounted, under the contact closure pressure which is exerted on it, directly on the element, the temperature of which it is intended to limit. This may for instance be the plate of an iron. In this case, it may be expedient if the fusible element and/or the thrust pin (both are advantageously elongate elements) engage through a cut-out in the bimetallic strip. In order to simplify assembly, it may furthermore be advantageous if the fusible element and the associated thrust pin are guided in captive fashion in a cut-out in the bimetallic strip, the fusible element/-thrust pin combination possibly having an annular shoulder the outside diameter of which is greater than the diameter of the cut-out in the bimetallic strip so that the fusible element/thrust pin combination is held equally loosely in the controller/limiter combination, the contact closure pressure between the first contact face of the fixed contact and the movable contact of the limiter being only established by the bracing on the heated element.

Simplification of assembly and also a particularly good transfer of heat between the heated element on the one hand and the fusible element on the other are possible if the fusible element is disposed in a depression in the heated element. When mention is made here of "dispose", then this means that during the installation process, the fusible element/thrust pin combination is introduced into the recess after which the arrangement is screwed for example onto the heated element, e.g., the plate of an iron.

The possibilities of installing the arrangement according to the invention become even more variable if the moving contact of the temperature limiter and possibly also the fixed contact are rotatably disposed on the supporting member. Thus, it is possible to adjust different relative positions between limiter and controller around the supporting member so that the arrangement can also be used in spatially limited housing zones, such as for example niches in housings and the like.

Adjustment of the relative angle between components of the controller and components of the limiter can be achieved in a particularly advantageous manner if the fixed contact is constructed as a substantially circular disc which protrudes radially and substantially evenly beyond the center of the supporting member. The term "projecting evenly" is intended to mean that the movable contact of the limiter can in all angular positions bias that contact face of the fixed contact which radially encircles the supporting member. This does not exclude the possibility of projections, depressions, contact tabs and the like being disposed on the periphery of the fixed contact which encircles the supporting member.

The foregoig and other objects and features of the invention will be further understood from the following detailed description of preferred embodiments thereof and from the drawings wherein like reference numerals identifying like parts and components.

DETAILED DESCRIPTION OF PREFERRED EMBODIMENTS AND PRACTICES

Figure 1:
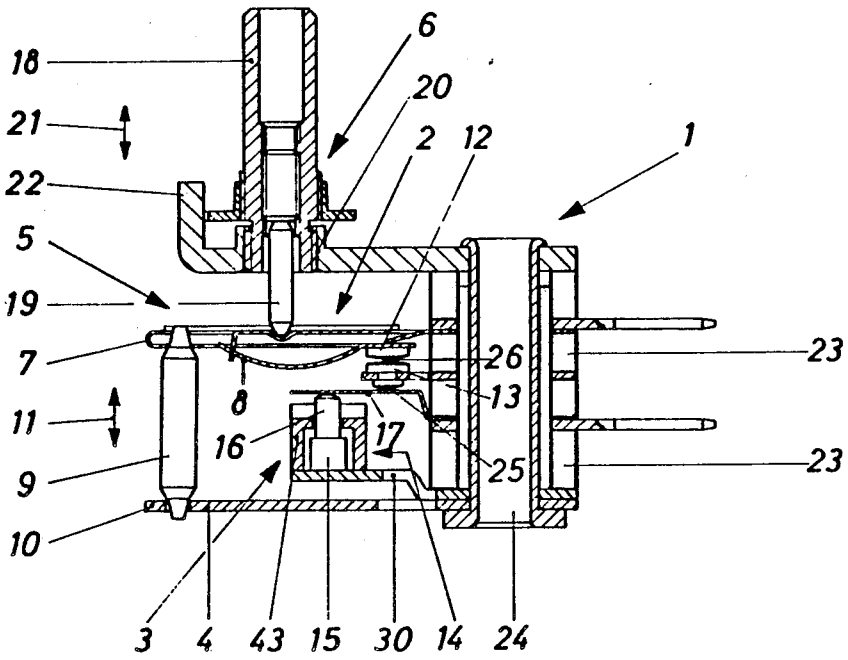
FIG. 1 shows a section through a first embodiment of switching arrangement according to the invention.

In FIG. 1, a thermally controlled electric switching arrangement 1 comprises a temperature controller 2 and a temperature limiter generally designated 3. The temperature controller 2 consists essentially of a bimetallic strip 4, which actuates a snap-action switch 5, the dead center position of which can be displaced by a manually operable setting device 6. The actuating end 7 of the snap-action switch springs 8 is connected by a transfer pin 9 to the pivoting end 10 of the bimetallic strip 4, so that if the transfer pin moves upwardly or downwardly in the direction of the arrow 11, the moving contact 12 of the temperature controller 12 is lifted off the fixed contact 13 or the contact path is closed.

The temperature limiter 3 comprises a melting metal fuse 14 which consists of a fusible element 15 engaged by a thrust pin 16. The moving contact 17 of the temperature limiter 3 is maintained by the thrust pin 16 in the closed position in relation to the fixed contact 13 so long as the limiter has not responded.

The setting device 6, which consists of a knob 18 by which an actuating pin 19 can be adjusted in the direction of the arrow 21 via a spindle transmission 20, is fixed via a support arm 22 together with contact springs, fixed contacts and bimetallic strip, on an elongate supporting member constructed as a hollow rivet 24 through interposed spacers 23.

The moving contact 17 of the temperature limiter 3, which is actuated by the thrust pin, biases a first (in the drawing) lower contact face 25 of the fixed contact 13 which is opposite the further contact face 26 of the fixed contact 13, which is biased by the moving contact 12 of the temperature controller 2.

The fixed contact 13 is constructed as a plate traversed by the supporting member (hollow river 24), the plate being biased on its upper side by the moving contact 12 of the snap-action switch 5 and on its underside by the moving contact 17 of the temperature limiter 3.

In the example of embodiment shown in FIG, 2, the temperature limiter is likewise integrated into the component elements of the temperature controller 2 but it is also possible for the temperature limiter 3 in relation to the temperature controller 2, to be disposed in a radially offset relationship around the hollow rivet 24. The fixed contact 113 comprises a contact nipple 27 biased on both sides by the two moving contacts 12, 17. In the case of the example of embodiment shown in FIG. 2, the fixed contact 13 extends substantially parallel with the bimetallic strip 4 and stands away from the supporting member, namely the hollow rivet 24, in the same direction as the bimetallic strip 4.

Furthermore, the fixed contact 13 and the moving contact 17 of the temperature limiter 3 are disposed between the snap-action switch 5 and the bimetallic strip 4, utilizing therefore in advantageous manner the free space created by the transfer pin 9. The fusible element 15 which can also be constrcuted as a prefabricated fusible cartridge with a thrust pin is supported on a heat transfer element 30 under the contact closing pressure exerted on it by the moving contact 17 of the temperature limiter 3 and the first contact face 25 on the one hand, as can be seen particularly in FIG. 1. The heat transfer element 30 projects into the free space between the snap-action switch 5 and the bimetallic strip 4 and extends substantially parallel with the bimetallic strip 4.

Figure 3:
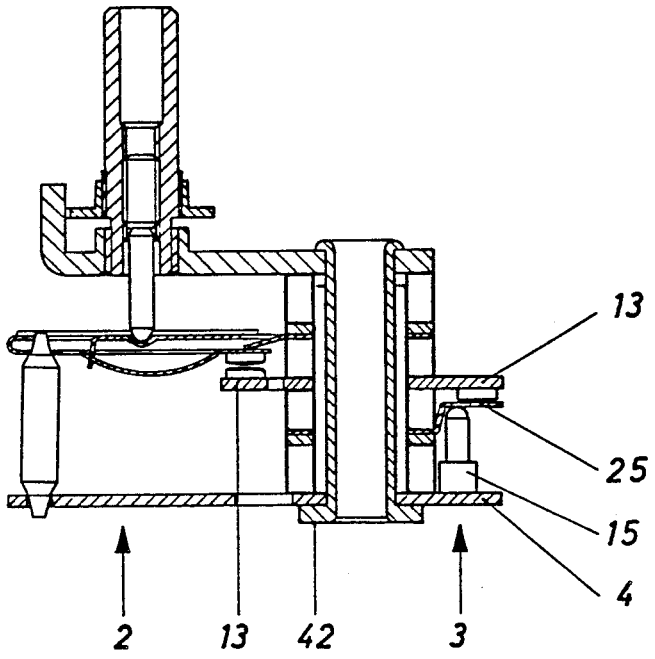
FIG. 3 shows a section through third embodiment of a switching arrangement according to the invention.

In the case of the example of embodiment shown in FIG. 3, the fusible element 5 is mounted on an extension of the bimetallic strip 4 and, in relation to the supporting member, is situated opposite the component parts of the temperature controller 2. It is, however, also possible to dispose the fusible element 15 on the other side of the root of the bimetallic strip.

Figure 2:
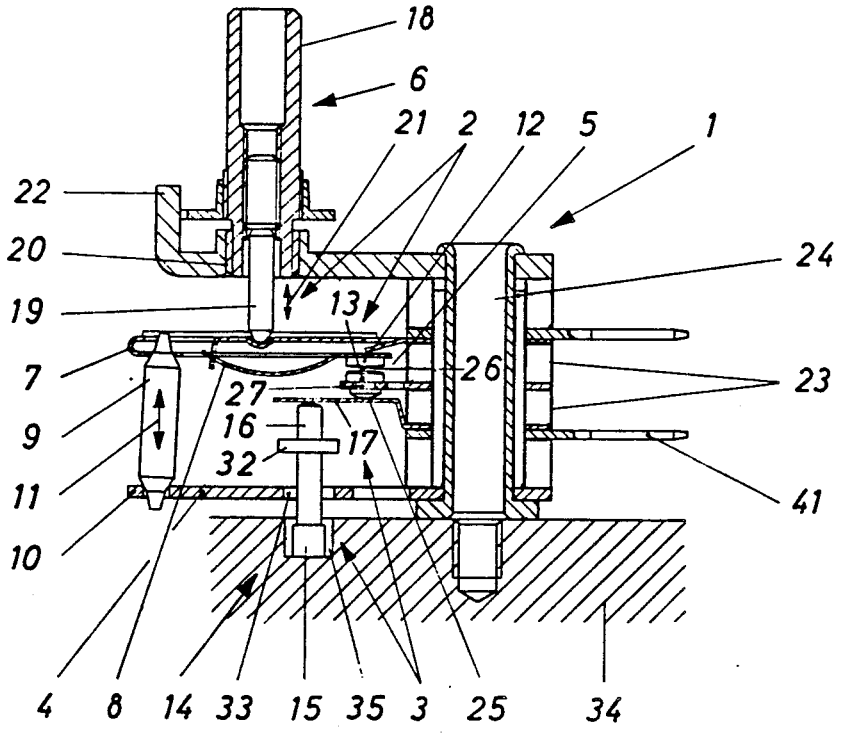
FIG. 2 shows a section through second embodiment of switching arrangement according to the invention.
Figure 4:
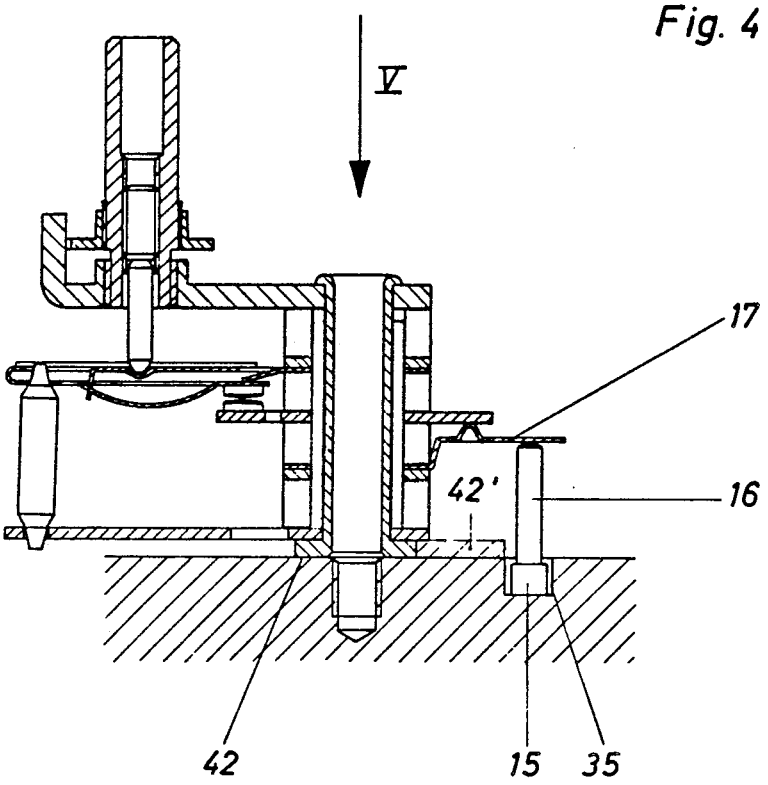
FIG. 4 shows a section through a fourth embodiment of a switching arrangement according to the invention.

FIGS. 2 and 4 show a particularly interesting solution in which the fusible element 15 is disposed directly in a recess in the heated element which is temperature controlled and temperature limited by the device, namely the plate of an iron. In the case of the example of embodiment shown in FIG. 2, the thrust pin 16 engages through the bimetallic strip 4 by which means it is guided for displacement within a cut-out in the bimetallic strip 4. In order to prevent its falling out of its desired position prior to the arrangement being installed, the thrust pin 16 has an annular shoulder 32 the outside diameter of which is larger than the diameter of the cut-out 33 in the bimetallic strip 4. The fusible element is disposed in a depression 35 in the heated element 34 so that when the fusible element 15 melts, the fused metal is to a certain degree separated from other electrical elements.

Figure 5:
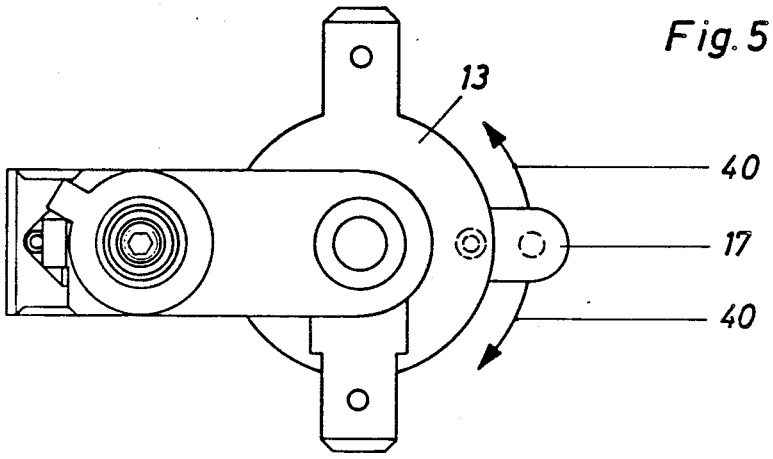
FIG. 5 is a plan view in the direction of the arrow V in FIG. 4.

In the case of the example of embodiment shown in FIGS. 3 and 4, the fixed contact 13 is constructed as a substantially circular disc which protrudes radially substantially evenly beyond the center of the supporting member. Thus, it is possible to dispose the moving contact 17 of the temperature limiter 3 so that it can rotate around the supporting member as indicated by the arrow 40 in FIG. 5. It is particularly advantageous if the rotary position of the moving contact 17 is lockable. This makes it possible easily to adapt the arrangement to whatever may be the particular circumstances of the applicances which is to be regulated and limited.

Disposed at the bottom end of the hollow rivet 24 is a heat transfer plate 42 which may be provided with a projection protruding radially beyond the periphery of the supporting member and carrying the fusible element 15. Such an embodiment is not shown in the drawings but it can be seen that for example in the case of the embodiment shown in FIG. 4 the heat transfer plate 42 comprises the projection 42' indicated by broken lines and on the upper face of which the fusible element 5 is mounted.

As also emerges from FIG. 1, the mounting of the fusible element may be enclosed by a housing part 43 which substantially engages in sealing tight manner around the fusible cartirdge sleeve and the thrust pin 16, so reliably avoiding the fused material interfering with the electrical efficiency of functioning of the arrangement when the fusion process takes place.

Various changes to the foregoing embodiments and modifications in practice may be introduced without departing from the invention. Accordingly, the particularly discussed and described preferred embodiments are intended in an illustrative and not in a limiting sense. The true spirit and scope of the invention is set forth in the following claims.

What is claimed is:

1. In a thermally controlled electrical switching arrangement for limiting the temperature of a heated or heating element, said arrangement being of the type having a temperature controller comprising
- a bimetallic strip, and
- a snap-action switch actuated by said bimetallic strip and having a movable contact and a contact spring, wherein a dead center position of said contact spring is displaceable by a manually operable setting device in order to influence the control point, and a temperature limiter constructed as a melting metal fuse having
- a fusible element,
- a pressure element and
- at least one switching contact member having a fixed contact and a movable contact maintained in closed position by the pressure element as long as the limiter has not responded, the improvement wherein said fixed contact of said limiter has respectively opposite first and second contact faces, wherein said movable contact of said limiter as influenced by said pressure element is in biased engagement with said first contact face of said fixed contact and wherein said movable contact of said temperature controller as influenced by said contact spring is in biased engagement with said second contact face of said fixed contact.

2. The invention claimed in claim 1 further including an elongate supporting member with interposed spacers for supporting said setting device, said contact spring, said fixed contact and said bimetallic strip, said fixed contact being constructed as a plate traversing said supporting member, said plate being biased on its upper face by said movable contact of said snap-action switch and on its underside by said movable contact of said temperature limiter.

3. The invention claimed in claim 2 wherein said supporting member is generally circular in cross-section, said temperature limiter and said temprature controller being disposed in radially staggered relation with respect to said supporting member.

4. The invention claimed in claims 1, 2 or 3 in which said fixed contact comprises at least one contact nipple biased on opposed sides thereof respectively by said movable contact of said temperature controller and by said movable contact of said temperature limiter.

5. The invention claimed in claims 2 or 3 in which said fixed contact extends substantially parallel with said bimetallic strip and extends from said supporting member in a common direction with said bimetallic strip.

6. The invention claimed in claim 1, 2 or 3 in which said fixed contact and said movable contact of said temperature limiter are disposed between said snap-action switch and said bimetallic strip.

7. The invention claimed in claims 2 or 3 further including a heat transfer element disposed with said supporting member and in which, under contact closure pressure exerted on said fusible element by said movable contact of said temperature limiter on the one hand and by said fixed contact on the other hand, said fusible element is supported by said heat transfer element.

8. The invention claimed in claims 1, 2 or 3 wherein said bimettalic member includes a root and wherein, under contact closure pressure exerted on said fusible element by said movable contact pressure of said temperature limiter on the one hand and by said fixed contact on the other hand, said fusible element is supported on said root of said bimetallic strip.

9. The invention claimed in claims 1, 2 or 3 in which, under contact closure pressure exerted on said fusible element between said movable contact of asid temperature limiter on the one hand and by said fixed contact on the one hand, said fusible element is mounted directly on said heated or heating element.

10. The invention claimed in claims 1, 2 or 3 further including a thrust pin secured with said fusible element and wherein said fusible element and/or said thrust pin extend through said bimetallic strip.

11. The invention claimed in claims 1, 2 or 3 further including a thrust pin secured with said fusible element and wherein said fusible element and/or said thrust pin are located in spaced relation from said bimetallic strip.

12. The invention claimed in claims 1, 2 or 3 wherein said bimetallic strip includes a cut-out and further including a thrust pin secured with said fusible element and wherein said fusible element and/or said thrust pin are displaceably guided in said bimetallic strip cut-out.

13. The invention claimed in claims 1, 2 or 3 wherein said bimetallic strip includes a cut-out and further including a thrust pin secured with said fusible element and wherein said fusible element and/or said thrust pin are displaceably guided in said bimetallic strip cut-out, said fusible element and/or thrust pin defining an annular shoulder, the outside diameter of said annular shoulder being greater than the diameter of said bimetallic strip cut-out.

14. The invention claimed in claims 1, 2 or 3 wherein said heated or heating element defines a depression in a surface thereof, said fusible element being disposed in said depression.

15. The invention claimed in claims 2 or 3 wherein either or both of said movable contact of said temperature limiter and said fixed contact are disposed for rotation on said supporting member.

16. The invention claimed in claims 2 or 3 wherein either or both of said movable contact of said temperature limiter and said fixed contact are disposed for rotation on said supporting member and wherein the rotary position thereof is in lockable relation to said supporting member.

17. The invention claimed in claims 2 or 3 wherein said fixed contact comprises an essentially circular disc which is centrally supported on said supporting member.

18. The invention claimed in claims 2 or 3 further including a thrust pin secured with said fusible element and wherein said movable contact of said temperature limiter comprises a contact spring a fixed end of which is clamped between said spacers on said supporting member, a free end of said contact spring being acted upon by said thrust pin and being directed away from said first contact face of said fixed contact.

19. The invention claimed in claims 1, 2 or 3 wherein said movable contact of said temperature limiter has one portion which is bent over in a Z-shape in the direction of said first contact face.

20. The invention claimed in claims 2 or 3 wherein said movable contact of said temperature limiter is provided with a contact tab which extends offset from said supporting member.

21. The invention claimed in claims 2 or 3 further including a heat transfer plate with said heated or heating element and supported at an end of said supporting member, said fusible element being disposed on said heat transfer plate.

22. The invention claimed in claims 2 or 3 further including a heat transfer plate with said heated or heating element and supported at an end of said supporting member, said heat transfer plate defining a projection which proturdes beyond the periphery of said supporting member, said fusible element being disposed on said projection.

23. The invention claimed in claims 2 or 3 further including a heat transfer plate with said heated or heating element and supported at an end of said supporting member, said heat transfer plate defining a projection which proturdes beyond the periphery of said supporting member, said fusible element being biasingly engaged with one surface of said projection, said projection having a second surface opposite said one surface in engagement with said heated or heating element.

24. The invention claimed in claims 1, 2 or 3 further including a housing having a portion thereof circumscribing said fusible element.

25. The invention claimed in claims 1, 2 or 3 further including a housing having a portion thereof circumscribing said fusible element and in spaced relation thereto.

* * * * *